US011574764B2

(12) United States Patent
Matsui et al.

(10) Patent No.: US 11,574,764 B2
(45) Date of Patent: Feb. 7, 2023

(54) DUST CORE, METHOD FOR MANUFACTURING DUST CORE, ELECTRIC/ELECTRONIC COMPONENT INCLUDING DUST CORE, AND ELECTRIC/ELECTRONIC DEVICE EQUIPPED WITH ELECTRIC/ELECTRONIC COMPONENT

(71) Applicant: Alps Alpine Co., Ltd., Tokyo (JP)

(72) Inventors: Masao Matsui, Niigata-ken (JP); Satoshi Maruyama, Niigata-ken (JP); Takao Mizushima, Niigata-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 445 days.

(21) Appl. No.: 15/622,580

(22) Filed: Jun. 14, 2017

(65) Prior Publication Data

US 2017/0278618 A1 Sep. 28, 2017

Related U.S. Application Data

(63) Continuation of application No. PCT/JP2015/080505, filed on Oct. 29, 2015.

(30) Foreign Application Priority Data

Jan. 22, 2015 (JP) ..... JP2015-010578

(51) Int. Cl.
*H01F 27/24* (2006.01)
*H01F 27/255* (2006.01)
(Continued)

(52) U.S. Cl.
CPC ..... *H01F 27/255* (2013.01); *H01F 1/14758* (2013.01); *H01F 1/15308* (2013.01);
(Continued)

(58) Field of Classification Search
CPC ..... H01F 1/15333; H01F 27/255; H01F 41/0226; H01F 27/24; H01F 1/15383
(Continued)

(56) References Cited

U.S. PATENT DOCUMENTS 5,470,646 A * 11/1995 Okamura ..... C21D 1/04 29/605
5,472,661 A * 12/1995 Gay ..... B22F 1/0059 419/10
(Continued)

FOREIGN PATENT DOCUMENTS

CN 1487535 4/2004
CN 1737955 2/2006
(Continued)

OTHER PUBLICATIONS

Korean Office Action for Korean Application No. 10-2017-7019104 dated Jul. 17, 2018.
(Continued)

*Primary Examiner* — Elvin G Enad
*Assistant Examiner* — Joselito S. Baisa
(74) *Attorney, Agent, or Firm* — Beyer Law Group LLP

(57) ABSTRACT

A dust core includes a compact containing a soft magnetic powder and also includes a cover coat for the compact. The cover coat contains a polyamideimide-modified epoxy resin. An electric/electronic component includes the dust core, a coil, and a connection terminal connected to each end portion of the coil. At least one portion of the dust core is placed so as to be located in an induced magnetic field generated by the current flowing in the coil through the connection terminal. An electric/electronic device includes the electric/electronic component.

20 Claims, 5 Drawing Sheets

(51) Int. Cl.

| | |
|---|---|
| ***H01F 3/08*** | (2006.01) |
| ***H01F 41/00*** | (2006.01) |
| ***H01F 1/153*** | (2006.01) |
| ***H01F 1/147*** | (2006.01) |
| ***H01F 27/29*** | (2006.01) |
| ***H01F 41/02*** | (2006.01) |
| *H01F 27/28* | (2006.01) |

(52) U.S. Cl.
CPC ..... *H01F 1/15333* (2013.01); *H01F 1/15383* (2013.01); *H01F 3/08* (2013.01); *H01F 27/29* (2013.01); *H01F 41/005* (2013.01); *H01F 41/0246* (2013.01); *H01F 27/2895* (2013.01)

(58) Field of Classification Search
USPC ..... 336/192
See application file for complete search history.

(56) References Cited

U.S. PATENT DOCUMENTS 5,629,092 A * 5/1997 Gay ..... H01F 1/0533 252/62.51 R
5,667,191 A * 9/1997 Nemoto ..... B29C 33/76 249/61
6,566,608 B2 * 5/2003 Yamaguchi ..... H01R 43/007 174/117 F
6,590,485 B2 * 7/2003 Fujiwara ..... H01F 1/0558 148/300
6,621,398 B2 * 9/2003 Fujiwara ..... H01F 3/10 148/300
6,856,231 B2 * 2/2005 Fujiwara ..... H01F 1/0552 336/233
6,906,608 B2 * 6/2005 Fujiwara ..... H01F 3/10 336/110
7,226,658 B2 * 6/2007 Sashi ..... C22C 38/02 428/336
7,812,484 B2 10/2010 Honkura et al.
7,898,875 B2 * 3/2011 Tao ..... G11C 11/413 365/189.05
8,106,739 B2 * 1/2012 Shpiro ..... H01F 41/041 336/223
8,123,874 B2 * 2/2012 Ishimine ..... B22F 1/0014 148/306
8,475,709 B2 * 7/2013 Bergmark ..... H01F 41/0246 419/11
8,686,820 B2 * 4/2014 Inaba ..... H01F 37/00 336/83
2001/0032733 A1 * 10/2001 Yamaguchi ..... H01R 43/007 174/117 F
2002/0109571 A1 * 8/2002 Fujiwara ..... H01F 29/146 336/178
2003/0165700 A1 * 9/2003 Kosuge ..... B32B 27/20 428/483
2004/0137247 A1 7/2004 Ono et al.
2004/0165917 A1 * 8/2004 Sugawara ..... G03G 15/2057 399/333
2004/0185278 A1 * 9/2004 Sato ..... H01G 2/20 428/469
2008/0151164 A1 * 6/2008 Takemoto ..... G02F 1/133634 349/118
2009/0266448 A1 * 10/2009 Ohta ..... B22D 11/06 148/121
2010/0167193 A1 * 7/2010 Nukada ..... G03G 5/0614 430/66
2011/0080248 A1 4/2011 Nishimura
2011/0147072 A1 * 6/2011 Yamashita ..... C23F 1/18 174/268
2011/0279216 A1 * 11/2011 Yoshida ..... C01G 49/009 336/233
2012/0097435 A1 * 4/2012 Goshima ..... C08G 18/7678 174/255
2013/0181802 A1 * 7/2013 Watanabe ..... B22F 1/02 336/221
2014/0138570 A1 * 5/2014 Otsuka ..... H01F 1/24 252/62.55
2014/0150247 A1 * 6/2014 Flores Ramirez ... C09D 179/08 427/520
2015/0371745 A1 * 12/2015 Araki ..... H01F 41/00 427/127
2016/0007455 A1 * 1/2016 Kawato ..... H05K 3/1283 427/559

FOREIGN PATENT DOCUMENTS

| | | | | |
|---|---|---|---|---|
| JP | 03137816 A * | 6/1991 | | |
| JP | H05-9366 | 1/1993 | | |
| JP | 08250355 A * | 9/1996 | | |
| JP | 2003-221546 | 8/2003 | | |
| JP | 2004-172263 | 6/2004 | | |
| JP | 2007012744 A * | 1/2007 | | |
| JP | 2007042891 A * | 2/2007 | ..... | B22F 1/0059 |
| JP | 2007-134591 | 5/2007 | | |
| JP | 3145832 U | 10/2008 | | |
| JP | 2010-238929 | 10/2010 | | |
| JP | 5327765 B | 8/2013 | | |
| JP | 2013-219147 | 10/2013 | | |
| JP | 2014-175531 | 9/2014 | | |
| WO | 2002/084676 | 10/2002 | | |
| WO | WO-2005083725 A1 * | 9/2005 | ..... | B22F 1/02 |
| WO | 2009/139368 | 11/2009 | | |
| WO | 2009-139368 | 11/2009 | | |
| WO | 2010-095496 | 8/2010 | | |

OTHER PUBLICATIONS

Chinese Office Action for Chinese Application No. 201580073889.9 dated Jul. 6, 2018.
International Search Report from International Application No. PCT/JP2015/080505 dated Jan. 12, 2016.

* cited by examiner

DUST CORE, METHOD FOR MANUFACTURING DUST CORE, ELECTRIC/ELECTRONIC COMPONENT INCLUDING DUST CORE, AND ELECTRIC/ELECTRONIC DEVICE EQUIPPED WITH ELECTRIC/ELECTRONIC COMPONENT

CLAIM OF PRIORITY

This application is a Continuation of International Application No. PCT/JP2015/080505 filed on Oct. 29, 2015, which claims benefit of Japanese Patent Application No. 2015-010578 filed on Jan. 22, 2015. The entire contents of each application noted above are hereby incorporated by reference.

BACKGROUND OF THE INVENTION

1. Field of the Invention

The present invention relates to a dust core, a method for manufacturing the dust core, an electric/electronic component including the dust core, and an electric/electronic device equipped with the electric/electronic component.

2. Description of the Related Art

Electric/electronic components such as reactors, transformers, and choke coils are used in electric/electronic devices such as power supply circuits in servers for data centers, boosting circuits for hybrid automobiles, generators, and transforming stations. In the electric/electronic components, a dust core is used as a magnetic member in some cases. The dust core can be obtained in such a manner that a large number of soft magnetic powders are compacted and an obtained compact is heat-treated.

The dust core is the compact of the soft magnetic powders as described above and therefore includes a cover coat from the viewpoint of increasing the mechanical strength in some cases. In this regard, Japanese Registered Utility Model No. 3145832 discloses a composite magnetic material, obtained by binding a soft magnetic metal powder with a non-magnetic material, for inductors. The non-magnetic material contains a forming aid added to and mixed with the soft magnetic metal powder and an impregnation resin that is impregnated into a compact of the soft magnetic metal powder and the forming aid in the form of a binder after the soft magnetic metal powder-forming aid compact is heat-treated. The impregnation resin has a thermosetting temperature of 180° C. or higher at atmospheric pressure.

Since an electric/electronic device including an electric/electronic component including the dust core is used in various environments, the dust core is used in an environment with a temperature of about 100° C. in some cases because the outside temperature is high or the electric/electronic device is located near a heat-generating component. In the case where the dust core is used in such a high-temperature environment, a material making up the dust core may possibly be heat-denatured. If the denaturation of the material varies magnetic properties of the dust core, particularly the core loss thereof, then the amount of heat generated from the dust core may possibly increase to promote the thermal denaturation of the dust core. Changes in magnetic properties of the dust core due to the use of the dust core in such a high-temperature environment may possibly affect the operation stability of the electric/electronic component, which includes the dust core. Thus, the following dust cores are demanded: dust cores that are unlikely to suffer from changes in magnetic properties even if the dust cores are used in the high-temperature environment. Furthermore, in the case where the dust cores are used in the high-temperature environment, the mechanical strength of the dust cores needs to be maintained in an appropriate range.

SUMMARY OF THE INVENTION

The present invention provides a dust core which is unlikely to suffer from changes in magnetic properties even if the dust core is used in a high-temperature environment and which has excellent mechanical properties, a method for manufacturing the dust core, an electric/electronic component including the dust core, and an electric/electronic device equipped with the electric/electronic component.

An embodiment of the present invention provides a dust core including a compact containing a soft magnetic powder and a cover coat for the compact. The cover coat contains a polyamideimide-modified epoxy resin (as used herein, this resin is simply referred to as "PAI-Ep resin" in some cases).

The dust core is more unlikely to suffer from changes in magnetic properties, particularly a change in core loss, as compared to dust cores including a cover coat containing a silicone resin (particularly a methylphenyl silicone resin) conventionally used even if the dust core is left in a high-temperature environment (particularly a 250° C. environment) for a long time (particularly 100 hours or more). In addition, the dust core can maintain practical mechanical strength even if the dust core is left in a high-temperature environment for a long time.

In the dust core, the soft magnetic powder may contain particles of at least one of iron-based materials and nickel-based materials. The iron-based materials and the nickel-based materials include relatively oxidizable materials, of which the oxidation is significant in a high-temperature environment in some cases. Even when the soft magnetic powder contains particles of such a relatively oxidizable material, the dust core is unlikely to suffer from changes in magnetic properties because the dust core according to the present invention includes the cover coat contains a PAI-Ep resin.

In the dust core, the soft magnetic powder may contain a powder of a crystalline magnetic material. The soft magnetic powder may contain a powder of an amorphous magnetic material. The soft magnetic powder may contain a powder of a nano-crystalline magnetic material. Alternatively, the soft magnetic powder may be a mixture of two or more of the crystalline magnetic material, the amorphous magnetic material, and the nano-crystalline magnetic material.

In the dust core, the compact may contain a binding component in addition to the soft magnetic powder and the binding component may be made of a pyrolysis residue of a binder component containing a resin material. When the compact contains the pyrolysis residue, cavities are likely to be caused in the compact. In the dust core, the PAI-Ep resin is capable of being located so as to fill the cavities. Therefore, changes in magnetic properties of the dust core due to the oxidation of a material making up the soft magnetic powder are unlikely to be caused.

Another embodiment of the present invention provides a method for manufacturing the dust core. The method includes a molding step of obtaining a molded product by a molding treatment including compacting a mixture containing the soft magnetic powder and the binder component; a heat treatment step of obtaining the compact by heating the molded product obtained through the molding step such that the compact contains the soft magnetic powder and the binding component made of the pyrolysis residue of the binder component; and a cover coat-forming step of forming the cover coat, which contains the polyamideimide-modified epoxy resin, in such a manner that the compact is contacted with a liquid composition containing at least one of a polyamideimide resin and a precursor thereof and an epoxy compound, a layer based on the liquid composition is thereby formed over regions including surfaces of the compact, and the reaction of an epoxy group contained in the epoxy compound contained in the layer based on the liquid composition is allowed to proceed. According to the method, the dust core can be efficiently manufactured so as to contain the binding component made of the pyrolysis residue of the binder component.

Another embodiment of the present invention provides an electric/electronic component including the dust core according to the present invention, a coil, and a connection terminal connected to each end portion of the coil. At least one portion of the dust core is placed so as to be located in an induced magnetic field generated by the current flowing in the coil through the connection terminal.

Another embodiment of the present invention provides an electric/electronic device including the electric/electronic component according to the present invention.

DESCRIPTION OF THE PREFERRED EMBODIMENTS

Embodiments of the present invention are described below in detail.

1. Dust Core

Figure 1A:
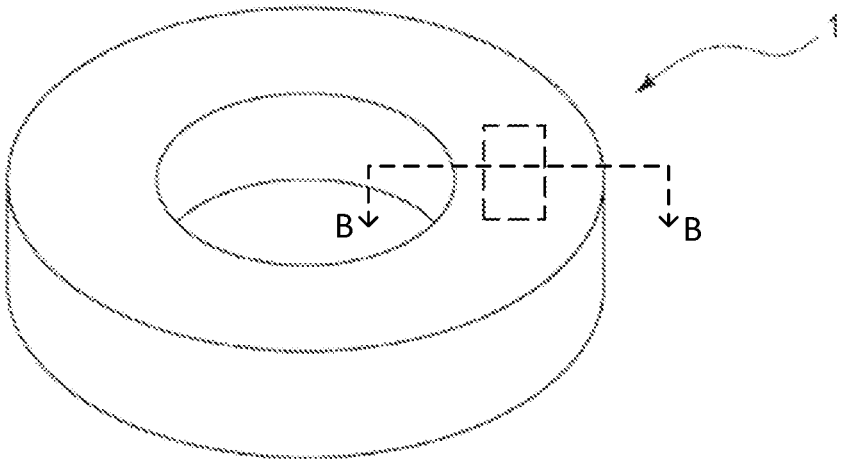
FIG. 1A is a perspective view schematically showing the shape of a dust core according to an embodiment of the present invention.

FIG. 1 shows a dust core 1 according to an embodiment of the present invention. The dust core 1 includes a compact which has a ring-shaped appearance and which contains a soft magnetic powder and also includes a cover coat for the compact. In the dust core 1, the cover coat contains a PAI-Ep resin. In a non-limited example, the compact contains a binding component binding the soft magnetic powder to other materials (the same type of materials in some cases or different types of materials in some cases) contained in the dust core 1.

(1) Compact (1-1) Soft Magnetic Powder

The soft magnetic powder may contain particles of at least one of iron-based materials containing iron and nickel-based materials containing nickel. The iron-based materials and the nickel-based materials include an oxidizable material. Even when the soft magnetic powder contains such an oxidizable material, the soft magnetic powder is unlikely to be oxidized because the dust core 1 includes the cover coat, which contains the PAI-Ep resin. Therefore, changes in magnetic properties of the dust core 1 due to the oxidation of the soft magnetic powder are unlikely to be caused. The inhibition of oxidation of the soft magnetic powder may possibly be one of reasons why the dust core 1 is obtained such that magnetic properties of the dust core are unlikely to be varied even if the dust core is used in a high-temperature environment, because the dust core includes the cover coat, which contains the PAI-Ep resin.

The soft magnetic powder may contain particles of a crystalline magnetic material. As used herein, the term "crystalline magnetic material" refers to a material that is a ferromagnetic material, particularly a soft magnetic material having a crystalline microstructure. The soft magnetic powder may be composed of the crystalline magnetic material particles. Examples of the crystalline magnetic material include an Fe—Si—Cr alloy, an Fe—Ni alloy, a Ni—Fe alloy, an Fe—Co alloy, an Fe—V alloy, an Fe—Al alloy, an Fe—Si alloy, an Fe—Si—Al alloy, carbonyl iron, and pure iron.

The soft magnetic powder may contain particles of an amorphous magnetic material. As used herein, the term "amorphous magnetic material" refers to a material that is a ferromagnetic material, particularly a soft magnetic material having a microstructure in which the volume of an amorphous portion is more than 50% of that of the microstructure. The soft magnetic powder may be composed of the amorphous magnetic material particles. Examples of the amorphous magnetic material include an Fe—Si—B alloy, an Fe—P—C alloy, and a Co—Fe—Si—B alloy. The amorphous magnetic material may be composed of a single type or multiple types of materials. A magnetic material making up the amorphous magnetic material particles is preferably one or more selected from the group consisting of the above-mentioned alloys. In particular, the magnetic material preferably contains the Fe—P—C alloy and is more preferably composed of Fe—P—C alloy.

An example of the Fe—P—C alloy is an Fe-based amorphous alloy represented by the composition formula Fe100 atomic %-a-b-c-x-y-z-tNiaSnbCrcPxCyBzSit, where 0 atomic %≤a≤10 atomic %, 0≤b≤3 atomic %, 0 atomic %≤c≤6 atomic %, 6.8 atomic %≤x≤13.0 atomic %, 2.2 atomic %≤y≤13.0 atomic %, 0 atomic %≤z≤9 atomic %, and 0 atomic %≤t≤7 atomic %. In the above composition formula, Ni, Sn, Cr, B, and Si are arbitrary additive elements.

The content a of Ni is preferably 0 atomic % to 7 atomic % and more preferably 4 atomic % to 6.5 atomic %. The content b of Sn is preferably 0 atomic % to 2 atomic % and more preferably 0 atomic % to 1 atomic %. The content c of Cr is preferably 0 atomic % to 2.5 atomic % and more preferably 1.5 atomic % to 2.5 atomic %. The content x of P is preferably 8.8 atomic % or more in some cases. The content y of C is preferably 2.2 atomic % to 9.8 atomic % in some cases. The content z of B is preferably 0 atomic % to 8.0 atomic % and more preferably 0 atomic % to 2 atomic %. The content t of Si is preferably 0 atomic % to 6 atomic % and more preferably 0 atomic % to 2 atomic %.

The soft magnetic powder may contain particles of a nano-crystalline magnetic material. As used herein, the term "nano-crystalline magnetic material" refers to a material that is a ferromagnetic material, particularly a soft magnetic material having a nano-crystalline microstructure containing grains, precipitated in a portion exceeding at least 50% of the microstructure, having an average grain size of several nanometers to several tens of nanometers. The nano-crystalline magnetic material may have an amorphous microstructure in addition to a nano-crystalline microstructure or may have the nano-crystalline microstructure only. The soft magnetic powder may be composed of the nano-crystalline magnetic material particles. Examples of the nano-crystalline magnetic material include an Fe—Cu-M-Si—B alloy, an Fe-M-B alloy, and an Fe—Cu-M-B alloy, where, M is one or more metal elements selected from Nb, Zr, Ti, V, Mo, Hf, Ta, and W.

The soft magnetic powder may be composed of a single type of powder or may be a mixture of multiple types of powders. An example of the mixture is a mixture of two or more of the crystalline magnetic material, the amorphous magnetic material, and the nano-crystalline magnetic material. Furthermore, in particular, the soft magnetic powder may be, for example, a mixture of the crystalline magnetic material particles and the amorphous magnetic material particles or may be a mixture pf the amorphous magnetic material particles and the nano-crystalline magnetic material particles.

The shape of particles contained in the soft magnetic powder is not particularly limited. The shape of the particles contained in the soft magnetic powder may be spherical or non-spherical. When the shape thereof is non-spherical, the shape thereof may be an anisotropic shape such as a scaly shape, an elliptical shape, a teardrop shape, or an acicular shape or may be an amorphous shape with no shape anisotropy. An example of an amorphous soft magnetic powder is the case where multiple spherical soft magnetic powders are bonded in contact with each other or are bonded so as to be partly embedded in another soft magnetic powder. Such an amorphous soft magnetic powder is likely to be observed when the soft magnetic powder is a carbonyl iron powder.

The shape of the particles contained in the soft magnetic powder may be a shape obtained at the stage of producing the soft magnetic powder or a shape obtained by secondarily processing the produced soft magnetic powder. A spherical shape, an elliptical shape, a teardrop shape, an acicular shape, and the like are exemplified as the shape of the former and a scaly shape is exemplified as the shape of the latter.

The particle diameter of the soft magnetic powder is not particularly limited. Supposing that the particle diameter thereof is defined by the median diameter D50 (the particle diameter where the cumulative volume is 50% in the particle size-volume distribution of the soft magnetic powder as determined by a laser diffraction/scattering method), the particle diameter thereof usually ranges from 1 μm to 45 μm. From the viewpoint of enhancing the handleability and the viewpoint of increasing the packing density of the soft magnetic powder in the compact of the dust core 1, the average particle diameter D50 of the soft magnetic powder is preferably 2 μm to 30 μm, more preferably 3 μm to 15 μm, and particularly preferably 4 μm to 13 μm.

(1-2) Binding Component

The composition of the binding component is not particularly limited insofar as the binding component is a material that contributes to fixing the soft magnetic powder. Examples of a material making up the binding component include organic materials such as a resin material and a pyrolysis residue of the resin material (as used herein, these are collectively referred to as the "resin material-based components) and inorganic materials. Examples of the resin material include an acrylic resin, a silicone resin, an epoxy resin, a phenol resin, a urea resin, and a melamine resin. Examples of the inorganic materials include glass materials such as water glass. The binding component may be composed of a single type of material or multiple materials. The binding component may be a mixture of an organic material and an inorganic material.

The binding component usually used is an insulating material. This enables insulation properties of the dust core 1 to be enhanced.

The compact is, for example, one manufactured by a method including a molding treatment including compacting a mixture containing the soft magnetic powder and a binder component. As used herein, the term "binder component" refers to a component providing the binding component. The binder component is made of the binding component in some cases or is a material different from the binding component.

Figure 1B:
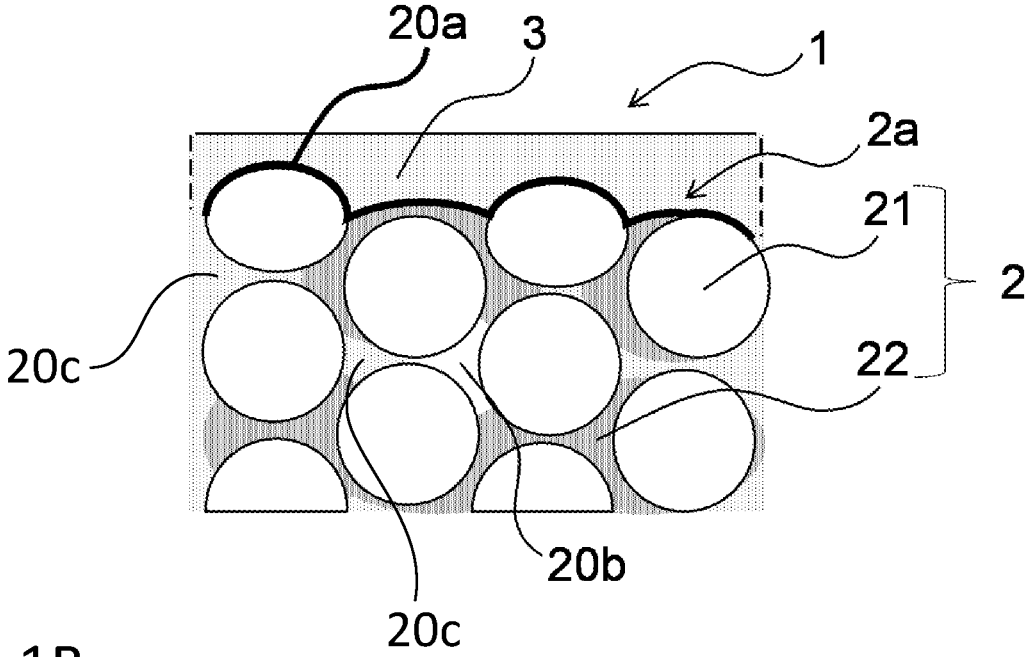
FIG. 1B is a schematic diagram showing an enlarged cross sectional view of the dust core in the vicinity of an outer surface thereof.

An example of the case where the binder component is different from the binding component is the case where the binding component is made of the pyrolysis residue of the binder component containing a resin material. When the pyrolysis residue is produced, the binder component is partly decomposed and is volatilized. Therefore, when the compact 2 contains the pyrolysis residue as the binding component 22, cavities 20*b* are caused in the compact 2, particularly between the particles contained in the soft magnetic powder 21 that located closest to each other in some cases, as shown in FIG. 1B. FIG. 1B is an enlarged schematic view of the dust core 1 in the vicinity of an outer surface 2*a* in a cross section taken along the line B-B shown in FIG. 1A. In these cases, in the dust core 1, the cover coat 3 is capable of being located so as to fill at least one of the cavities. Therefore, changes in magnetic properties of the dust core 1 due to the oxidation of a material making up the soft magnetic powder are unlikely to be caused.

(2) Cover Coat

The dust core 1 includes the cover coat 3. The cover coat 3 is a layer that is placed so as to cover at least one portion of the compact 2 for the purpose of increasing the mechanical strength of the compact. The compact is formed by compacting a mixture containing the soft magnetic powder 21 and therefore has a surface 2*a* having irregularities 20*a* derived from the soft magnetic powder 21 in some cases. When this mixture contains the binder component and the compact 21 contains the pyrolysis residue of the binder component, as the binding component 22, the compact may possibly have the cavities 20*a* as described above. In this case, a material making up the cover coat 3 may be present not only on a surface 2*a* of the compact but also in a region extending to an inner portion from the surface thereof to a certain extent. That is, the cover coat may have an impregnation structure 20*c* with respect to the compact 2.

The cover coat 3 contains the PAI-Ep resin. An example of a non-limited method for preparing the cover coat 3 is as described below. First, the compact is contacted with a liquid composition containing at least one of a polyamideimide resin and a precursor thereof and an epoxy compound, whereby a layer based on the liquid composition is formed over regions including surfaces of the compact. The layer based on the liquid composition is heated such that the reaction of an epoxy group contained in the epoxy compound proceeds, whereby the cover coat is formed so as to include a layer containing the PAI-Ep resin, which is a product of the reaction of the polyamideimide resin with the epoxy compound.

Since the liquid composition is in a state before the reaction of the epoxy group proceeds, the liquid composition has relatively low viscosity and is likely to permeate the compact. Thus, the cover coat 3, which is prepared by the above method and contains the PAI-Ep resin, is likely to have the impregnation structure 20*c* with respect to the compact. A portion of the cover coat that is impregnated into the compact has an anchoring effect to increase the adhesion of the cover coat to the compact. Since the liquid composition permeates the compact, many of the particles contained in the soft magnetic powder 21, which is contained in the compact, are directly or indirectly covered with the liquid composition. Therefore, the particles contained in the soft magnetic powder 21 are directly or indirectly covered by the material making up the cover coat as shown in FIG. 1B. Thus, even if the dust core 1 is left in a high-temperature environment, the dust core 1 is unlikely to suffer from changes in magnetic properties due to oxidation.

A material, such as a polyimide resin, having a function equivalent to or higher than that of the PAI-Ep resin is present in terms of suppressing oxidation only. However, such a material, as well as the polyimide resin, often has a glass transition point higher than that of the PAI-Ep resin. Therefore, in the case of using such a material to form the cover coat by a method including a step of solidifying the liquid composition, the heating temperature necessary for solidification is high. The fact that the heating temperature is high means that the cooling temperature range to room temperature is wide. Therefore, forming the cover coat using the polyimide resin is likely to increase the degree of shrinkage of the material making up the cover coat to strain the particles contained in the soft magnetic powder. When the residual strain in the particles contained in the soft magnetic powder is large, it is difficult to enhance magnetic properties of the dust core 1.

When the PAI-Ep resin is made of at least one of the polyamideimide resin and the precursor thereof and the liquid composition, which contains the epoxy compound, the detailed structure (the molecular weight, the structure of a side chain, or the like) of the polyamideimide resin is not particularly limited insofar as the PAI-Ep resin contains a carboxy group capable of reacting an epoxy group. The PAI-Ep resin preferably has solubility in a solvent in some cases.

The type of the epoxy compound, which is contained in the liquid composition, is not particularly limited. The epoxy compound may contain two or more epoxy groups. Examples of the epoxy compound include bisphenol-A epoxy compounds; bisphenol-F epoxy compounds; compounds, such as biphenyl epoxy compounds, containing terminal epoxy groups; naphthalene epoxy compounds; ortho-cresol novolac epoxy compounds; and oligomer compounds, such as epoxy compounds having constitutional units based on dicyclopentadiene, containing many epoxy groups. In particular, the epoxy compound is preferably one or more selected from the group consisting of the bisphenol-A epoxy compounds and dicyclopentadiene epoxy compounds in some cases.

In the liquid composition, the relationship between the content of at least one of the polyamideimide resin and the precursor thereof and the content of the epoxy compound is not limited. The relationship therebetween may be set in consideration of the carboxylic acid equivalent of the polyamideimide resin and the epoxy equivalent of the epoxy compound. In usual, the polyamideimide resin and the epoxy compound are blended together such that all carboxy groups of the polyamideimide resin react with all epoxy groups of the epoxy compound.

Since the cover coat contains the PAI-Ep resin or is made of the PAI-Ep resin in a preferable embodiment, changes in magnetic properties of the dust core 1 are unlikely to be caused even when the dust core 1 is left in a 250° C. environment. In particular, in the case where the dust core 1 is left in the above environment for 200 hours, the rate of increase in core loss thereof can be set to 30% or less. Furthermore, in the case where the dust core 1 is left in the above environment for 200 hours, the rate of reduction in relative magnetic permeability thereof can be set to 14% or less (the rate of change thereof can be set to −14% or more).

Since the cover coat contains the PAI-Ep resin or is made of the PAI-Ep resin in a preferable embodiment, the reduction in mechanical strength of the dust core 1 is unlikely to be caused even when the dust core 1 is left in a 250° C. environment. In particular, in the case where the dust core 1 is left in the above environment for 200 hours, the radial crushing strength thereof can be set to about 20 MPa or more.

(3) Method for Manufacturing Dust Core

A method for manufacturing the dust core 1 is not particularly limited. Using a manufacturing method below allows the dust core 1 to be more efficiently manufactured.

The method for manufacturing the dust core 1 includes a molding step and a cover coat-forming step and may further include a heat treatment step as described below.

(3-1) Molding Step

First, a mixture containing the soft magnetic powder and the binder component is prepared. A molded product can be obtained by the molding treatment including compacting the mixture. Pressing conditions are not particularly limited and are appropriately determined on the basis of the composition of the binder component. When the binder component is made of, for example, a thermosetting resin, the curing reaction of the thermosetting resin is preferably allowed to proceed in such a manner that the resin is pressed and heated in a die. On the other hand, in the case of compacting, though the pressing force is high, heating is not necessary and pressing is performed in a short time.

The case where the mixture is a granulated powder and is compacted is described below in detail. The granulated powder is excellent in handleability and therefore can enhance the workability of a compacting step in which the molding time is short and which is excellent in productivity.

(3-1-1) Granulated Powder

The granulated powder contains the soft magnetic powder and the binder component. The content of the binder component in the granulated powder is not particularly limited. When the content thereof is excessively low, the binder component is unlikely to hold the soft magnetic powder. When the content of the binder component is excessively low, the binding component, which is made of the pyrolysis residue of the binder component, is unlikely to insulate the particles contained in the soft magnetic powder from each other in the dust core 1 obtained through the heat treatment step. However, when the content of the binder component is excessively high, the content of the binding component in the dust core 1 obtained through the heat treatment step is likely to be high. When the content of the binding component in the dust core 1 is high, magnetic properties of the dust core 1 are likely to be reduced by the influence of the stress received by the soft magnetic powder from the binding component. Therefore, the content of the binder component in the granulated powder is preferably 0.5% by mass to 5.0% by mass with. From the viewpoint of stably reducing the possibility that magnetic properties of the dust core 1 are reduced, the content of the binder component in the granulated powder is preferably 1.0% by mass to 3.5% by mass and more preferably 1.2% by mass to 3.0% by mass.

The granulated powder may contain a material other than the soft magnetic powder and the binder component. Examples of such a material include a lubricant, a silane coupling agent, and an insulating filler. When the lubricant is contained therein, the type of the lubricant is not particularly limited. The lubricant may be an organic lubricant or an inorganic lubricant. Examples of the organic lubricant include metal soaps such as zinc stearate and aluminium stearate. It is conceivable that the organic lubricant is evaporated in the heat treatment step and scarcely remains in the dust core 1.

A method for producing the granulated powder is not particularly limited. The granulated powder may be obtained in such a manner that a component providing the granulated powder is directly kneaded and an obtained kneaded product is crushed by a known method. Alternatively, the granulated powder may be obtained in such a manner that slurry is prepared by adding a solvent (an example thereof is a solvent medium, a dispersion medium, or water) to the above component, followed by drying the slurry and crushing. The particle size distribution of the granulated powder may be controlled in such a manner that sieving or classification is performed after crushing.

Figure 2:
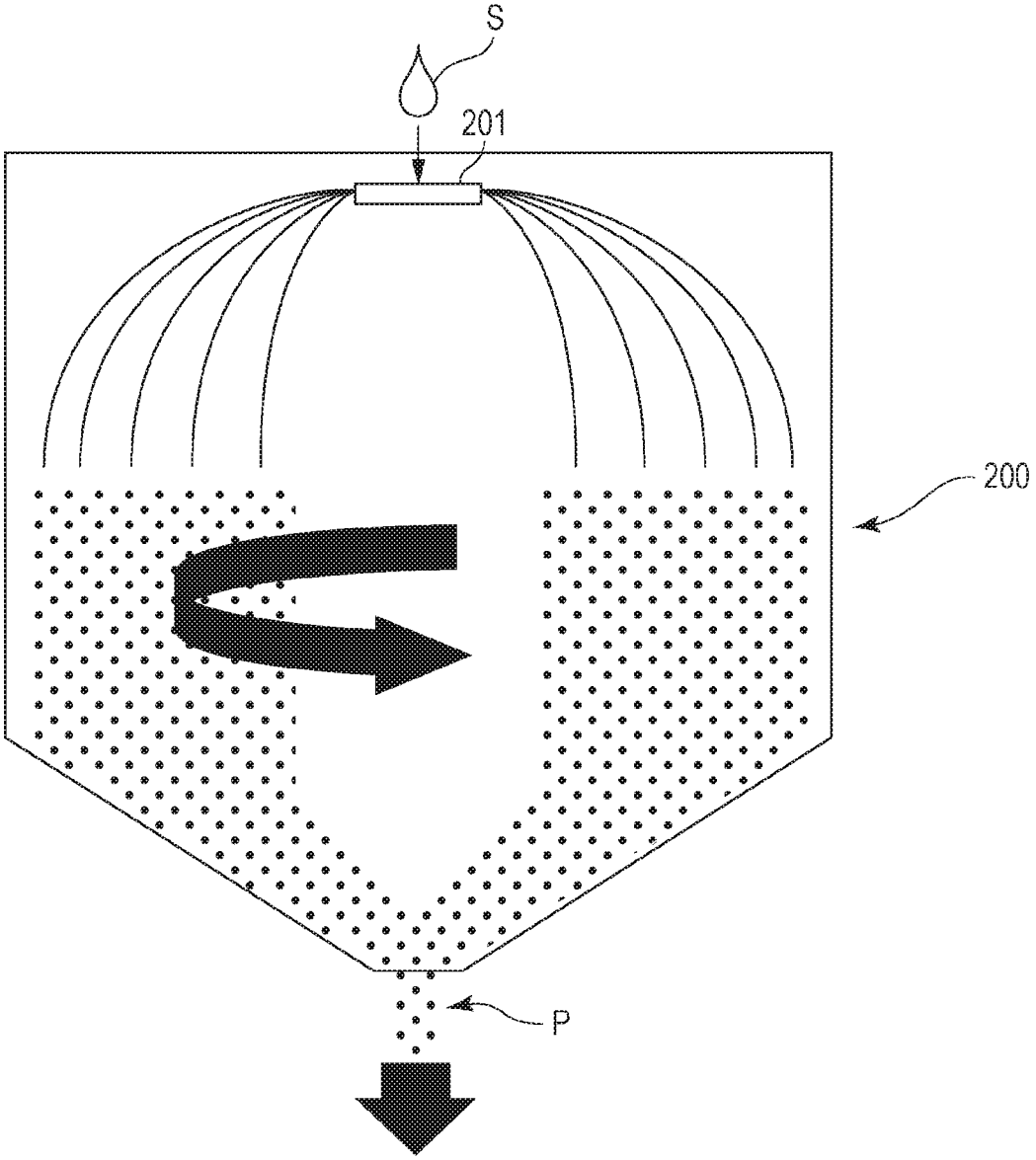
FIG. 2 is an illustration schematically showing a spray dryer system used in an example of a method for producing a granulated powder and the operation thereof.

An example of a method for obtaining the granulated powder from the above slurry is a method using a spray dryer. As shown in FIG. 2, a rotor 201 is placed in a spray dryer system 200 and slurry S is supplied to the rotor 201 from an upper portion of the spray dryer system 200. The rotor 201 rotates at a predetermined number of revolutions and sprays the slurry S in a chamber inside the spray dryer system 200 by means of centrifugal force in the form of small droplets. Furthermore, hot air is introduced into the chamber inside the spray dryer system 200, whereby a dispersion medium (water) contained in small droplets of the slurry S is evaporated with the shape of the small droplets maintained. As a result, a granulated powder P is formed from the slurry S. The granulated powder P is collected from a lower portion of the spray dryer system 200.

Parameters such as the number of revolutions of the rotor 201, the temperature of the hot air introduced into the spray dryer system 200, and the temperature of a lower portion of the chamber may be appropriately set. Examples of the preset ranges of these parameters are as follows: the number of revolutions of the rotor 201 is 4,000 rpm to 6,000 rpm, the temperature of the hot air introduced into the spray dryer system 200 is 130° C. to 170° C., and the temperature of the lower portion of the chamber is 80° C. to 90° C. The atmosphere and pressure in the chamber may also be appropriately set. For example, the atmosphere in the chamber is air and the difference between the pressure in the chamber and atmospheric pressure is 2 mm H2O (about 0.02 kPa). The particle size distribution of the obtained granulated powder P may be controlled by sieving or the like.

(3-1-2) Pressing Conditions

Pressing conditions in compacting are not particularly limited. The pressing conditions may be appropriately set in consideration of the composition of the granulated powder, the shape of the molded product, or the like. When the pressing force to compact the granulated powder is excessively low, the molded product has reduced mechanical strength. Therefore, the following problems are likely to occur: problems such as the reduction in handleability of the molded product and the reduction in mechanical strength of the dust core 1, which is obtained from the molded product. Furthermore, the dust core 1 has reduced magnetic properties or reduced insulating properties in some cases. However, when the pressing force to compact the granulated powder is excessively high, it is difficult to prepare a molding die resistant to the pressing force.

From the viewpoint of stably reducing the possibility that the molding step negatively affects mechanical properties or magnetic properties of the dust core 1 and the viewpoint of readily performing industrial mass-production, the pressing force to compact the granulated powder is preferably 0.3 GPa to 2 GPa in some cases, more preferably 0.5 GPa to 2 GPa in some cases, and particularly preferably 0.5 GPa to 1.8 GPa in some cases.

In compacting, pressing may be performed during heating or may be performed at room temperature.

(3-2) Heat Treatment Step

The molded product, which is obtained through the molding step, may be the compact. The compact may be obtained by heat-treating the molded product as described below.

In the heat treatment step, the molded product, which is obtained through the molding step, is heated such that magnetic properties are adjusted by modifying the distance between the particles contained in the soft magnetic powder and by relieving the strain applied to the particles contained in the soft magnetic powder in the molding step, whereby the compact is obtained.

The heat treatment step aims to adjust magnetic properties of the compact as described above and therefore heat treatment conditions such as the heat treatment temperature are set such that magnetic properties of the compact are optimized. An example of a method for setting the heat treatment conditions is such that the heating temperature of the molded product is varied and other conditions such as the heating rate and the holding time at the heating temperature thereof are kept constant.

Upon setting the heat treatment conditions, standards for evaluating magnetic properties of the compact are not particularly limited. The core loss of the compact can be cited as an example of an evaluation item. In this case, the heating temperature of the molded product may be set such that the core loss of the compact is minimized. Conditions for measuring the core loss are appropriately set. For example, conditions including a frequency of 100 kHz and a maximum magnetic flux density of 100 mT are cited.

An atmosphere for heat treatment is not particularly limited. In the case of an oxidizing atmosphere, the possibility that the pyrolysis of the binder component proceeds excessively or the possibility that the oxidation of the soft magnetic powder proceeds is high. Therefore, heat treatment is preferably performed in an inert atmosphere such as a nitrogen atmosphere or an argon atmosphere or a reducing atmosphere such as a hydrogen atmosphere.

(3-3) Cover Coat-Forming Step

The cover coat, which contains the PAI-Ep resin, is applied to the compact including the molded product obtained through the molding step or the compact obtained by treating the molded product in the heat treatment step.

In particular, the compact is contacted with the liquid composition, which contains at least one of the polyamide-imide resin and the precursor thereof and the epoxy compound, whereby the layer based on the liquid composition is formed over regions including surfaces of the compact. The layer based on the liquid composition is heated such that the reaction of the epoxy group contained in the epoxy compound proceeds, whereby the cover coat is formed so as to include the layer containing the PAI-Ep resin, which is the product of the reaction of the polyamideimide resin with the epoxy compound.

At least one of the polyamideimide resin and the precursor thereof and the epoxy compound, which are contained in the liquid composition, are as described above and therefore will not be described in detail. The liquid composition may contain a solvent. The type of the solvent is not particularly limited and the solvent may appropriately dissolve at least one component contained in the liquid composition and may be capable of volatilizing appropriately in use. Examples of the solvent include esters such as butyl acetate and ketones such as methyl ethyl ketone. The content of the solvent in the liquid composition is set in consideration of the viscosity of the liquid composition.

Conditions for forming the cover coat from the layer based on the liquid composition are appropriately set depending on the composition of the liquid composition. In a non-limited example, the cover coat, which contains the PAI-Ep resin, can be obtained in such a manner that the solvent is volatilized by holding the liquid composition at a temperature of about 80° C. to 120° C. for 10 minutes to 30 minutes and the reaction of the epoxy group is allowed to proceeds by further holding the liquid composition at a temperature of about 150° C. to 250° C. for 20 minutes to 2 hours.

2. Electric/Electronic Component

An electric/electronic component according to an embodiment of the present invention includes the dust core 1. In particular, the electric/electronic component includes the dust core 1, a coil, and a connection terminal connected to each end portion of the coil. Herein, at least one portion of the dust core is placed so as to be located in an induced magnetic field generated by the current flowing in the coil through the connection terminal.

Figure 3:
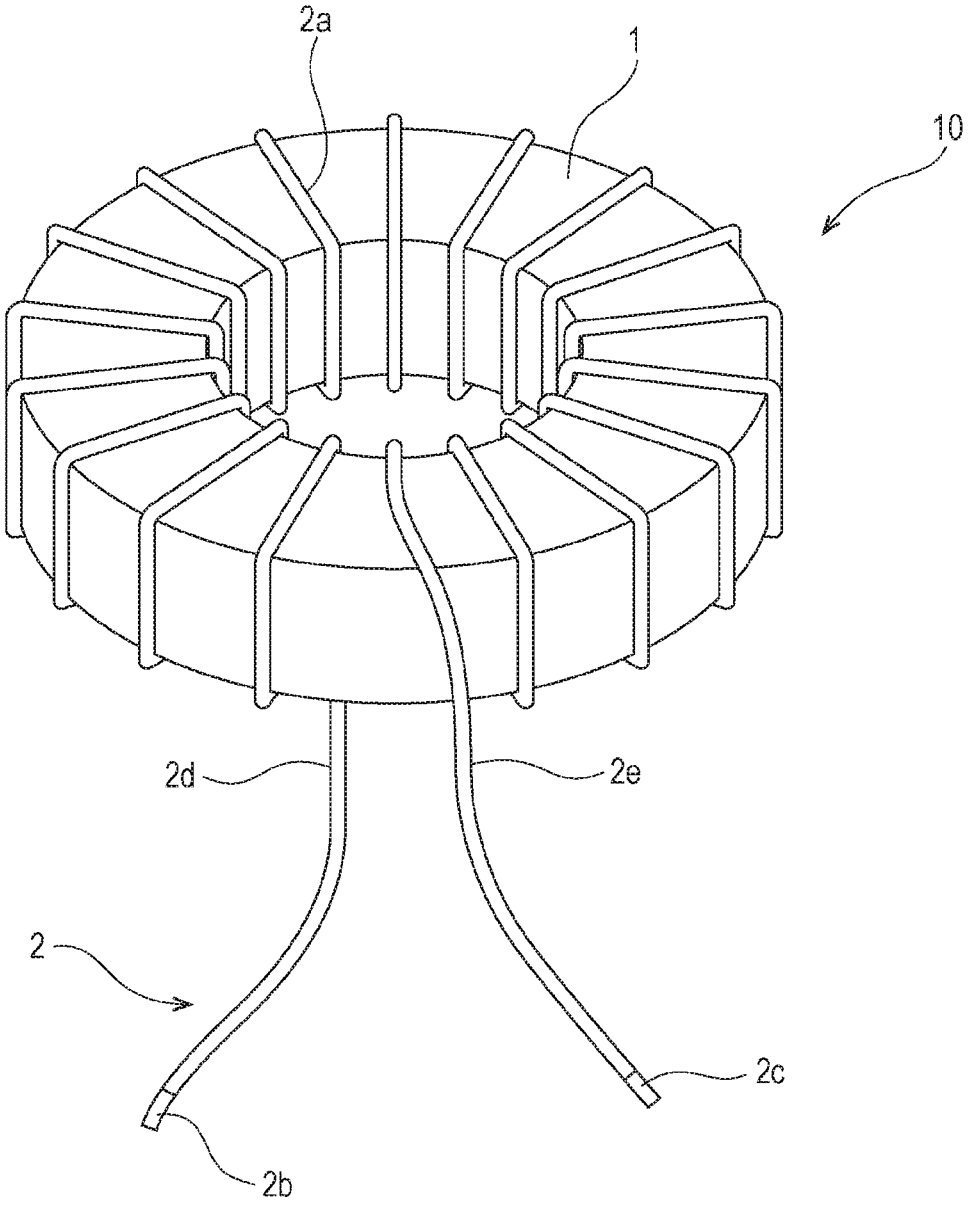
FIG. 3 is a perspective view schematically showing the shape of a toroidal coil which includes a dust core according to an embodiment of the present invention and which is an electronic component.

An example of the electric/electronic component is a toroidal coil 10 shown in FIG. 3. The toroidal coil 10 includes the dust core 1, which is ring-shaped, and a coil 2*a* formed by winding a coated conductive wire 2 around the dust core 1. End portions 2*d* and 2*e* of the coil 2*a* can be defined in sections of the coated conductive wire 2 that are located between the coil 2*a*, around which the coated conductive wire 2 is wound, and end portions 2*b* and 2*c* of the coated conductive wire 2. As described above, in the electric/electronic component, a member making up a coil and a member making up connection terminals may be the same.

Since the electric/electronic component includes the dust core 1, properties of the electric/electronic component are unlikely to be deteriorated due to changes in magnetic properties of the dust core 1 even if the electric/electronic component is left in a high-temperature environment (particularly a 250° C. environment) for a long time (particularly 100 hours or more). Even if the electric/electronic component is left in the above environment for a long time, the dust core 1 can maintain practical mechanical strength. Therefore, in the course of manufacturing the electric/electronic component using the dust core 1, in the course of mounting or installing the electric/electronic component as a part of an electric/electronic device, or in the use of the obtained electric/electronic device, failures due to the breakage of the electric/electronic component are unlikely to be caused even if a mechanical load is applied to the electric/electronic component from outside because of a collision with another component or the like or thermal stress is applied to the electric/electronic component because of a rapid change in temperature.

Examples of the electric/electronic component include reactors, transformers, and choke coils in addition to the toroidal coil 10.

3. Electric/Electronic Device

An electric/electronic device according to an embodiment of the present invention includes the electric/electronic component, which includes the dust core 1. In particular, those having the electric/electronic component mounted therein and those having the electric/electronic component installed therein are exemplified. Examples of the electric/electronic device include switching power supplies equipped with a voltage step-up/down circuit, a smoothing circuit, a DC-AC converter, an AC-DC converter, or the like and power control units used for solar power generation.

Since the electric/electronic device includes the electric/electronic component, which includes the dust core 1, operation failures due to the reduction of magnetic properties of the dust core 1 or the breakage of the dust core 1 are unlikely to be caused even if the electric/electronic device is left in a high-temperature environment (particularly a 250° C. environment) for a long time (particularly 100 hours or more). Thus, the electric/electronic device is excellent in reliability.

The aforementioned embodiments have been described for the purpose of facilitating the understanding of the present invention and are not intended to limit the present invention. Accordingly, elements disclosed in the embodiments are intended to include all design modifications and equivalents belonging to the technical scope of the present invention.

EXAMPLES

The present invention is further described below in detail with reference to examples and the like. The scope of the present invention is not limited to the examples or the like.

Example 1

(1) Preparation of Soft Magnetic Powder

By a water atomization method, a soft magnetic powder was prepared from powders of amorphous magnetic materials that were weighed so as to give the composition Fe74.3 atomic % Cr1.56 atomic % P8.78 atomic % C2.62 atomic % B7.57 atomic % Si4.19 atomic %. The particle size distribution of the obtained soft magnetic powder was measured with "Microtrac Particle Size Distribution Analyzer MT 3300EX" manufactured by Nikkiso Co., Ltd. in terms of a volume distribution. As a result, the median diameter D50, which is the diameter corresponding to 50% in the volume distribution, was 11 μm.

(2) Preparation of Granulated Powder

Slurry was prepared so as to contain 98.3 parts by mass of the soft magnetic powder, 1.4 parts by mass of an insulating binding material made of an acrylic resin, 0.3 parts by mass of a lubricant made of zinc stearate, and water acting as a solvent.

The obtained slurry was dried and was then crushed, followed by removing fine particles with a size of 300 μm or less and coarse particles with a size of 850 μm or more using a sieve with 300 μm openings and a sieve with 850 μm openings, respectively, whereby a granulated powder was obtained.

(3) Compacting

The obtained granulated powder was filled into a die and was compacted with a surface pressure of 0.5 GPa to 2 GPa, whereby a molded product having a ring shape and a size of 20 mm in outside diameter×12.8 mm in inside diameter×6.8 mm in thickness was obtained.

(4) Heat Treatment

The obtained molded product was placed in a furnace with a nitrogen flow atmosphere and was heat-treated in such a manner that the temperature in the furnace was increased from room temperature (23° C.) to a temperature of 300° C. to 500° C., which is the optimum core heat treatment temperature, at a heating rate of 10° C./min and the molded product was held at this temperature for 1 hour and was then cooled to room temperature in the furnace, whereby a compact was obtained.

(5) Cover Coat

A liquid composition (a viscosity of 1 mPa·s to 10 mPa·s) was prepared by dissolving a polyamideimide resin (a carboxylic acid equivalent of 1,255 g/eq) and a bisphenol-A epoxy resin (an epoxy equivalent of 189 g/eq) in a solvent. The content of the polyamideimide resin and the content of the bisphenol-A epoxy resin were set such that the number of carboxy groups in the polyamideimide resin and the number of epoxy groups in the bisphenol-A epoxy resin were equal to each other.

The compact was immersed in the obtained liquid composition for 15 minutes. Thereafter, the compact was taken out of the liquid composition, was dried at 70° C. for 30 minutes, and was further dried at 100° C. for 30 minutes, whereby a coating of the liquid composition was formed on the compact. The compact provided with the coating was heated at 170° C. for 1 hour, whereby a dust core including the compact and a cover coat thereon was obtained.

Example 2

A dust core was obtained in substantially the same manner as that used in Example 1 except that an epoxy compound (an epoxy equivalent of 265 g/eq) having constitutional units based on dicyclopentadiene was used to obtain a liquid composition with a viscosity of 1 mPa·s to 10 mPa·s instead of the bisphenol-A epoxy resin when a liquid composition was prepared.

Example 3

A dust core was obtained in substantially the same manner as that used in Example 1 except that an ortho-cresol novolac epoxy compound (an epoxy equivalent of 210 g/eq) was used to obtain a liquid composition with a viscosity of 1 mPa·s to 10 mPa·s instead of the bisphenol-A epoxy resin when a liquid composition was prepared.

Comparative Example 1

A compact was obtained in the same manner as that used in Example 1. A liquid composition with a viscosity of 1 mPa·s to 10 mPa·s was prepared by dissolving a methylphenyl silicone resin in a solvent. The compact was immersed in the obtained liquid composition for 15 minutes. Thereafter, the compact was taken out of the liquid composition and was dried at room temperature for 60 minutes, whereby a coating of the liquid composition was formed on a surface of the compact. The compact provided with the coating was heated at 250° C. for 1 hour, whereby a dust core including the compact and a cover coat thereon was obtained.

Comparative Example 2

A compact was obtained in the same manner as that used in Example 1. A liquid composition with a viscosity of 1 mPa·s to 10 mPa·s was prepared by dissolving an epoxy-modified silicone resin in a solvent. The compact was immersed in the obtained liquid composition for 15 minutes. Thereafter, the compact was taken out of the liquid composition and was dried at 70° C. for 30 minutes, whereby a coating of the liquid composition was formed on a surface of the compact. The compact provided with the coating was heated at 170° C. for 1 hour, whereby a dust core including the compact and a cover coat thereon was obtained.

Experiment Example 1

Measurement of rate change in relative magnetic permeability

A toroidal coil was obtained by winding a copper wire around the dust core prepared in each of the examples and the comparative examples. The toroidal coil was measured for relative magnetic permeability at a frequency of 100 kHz using an impedance analyzer ("4192 A" manufactured by HP Inc.). The relative magnetic permeability is referred to as "initial relative magnetic permeability μ0".

The toroidal coil was left in a 250° C. environment for a predetermined time. After being left therein, the toroidal coil was measured for relative magnetic permeability in the above manner. The relative magnetic permeability is referred to as "post-heating relative magnetic permeability μ1".

The rate Rμ (%) of change in relative magnetic permeability was determined by the following equation:

$$R\mu=(\mu1-\mu0)/\mu0\times100 \quad 1.$$

Figure 4:
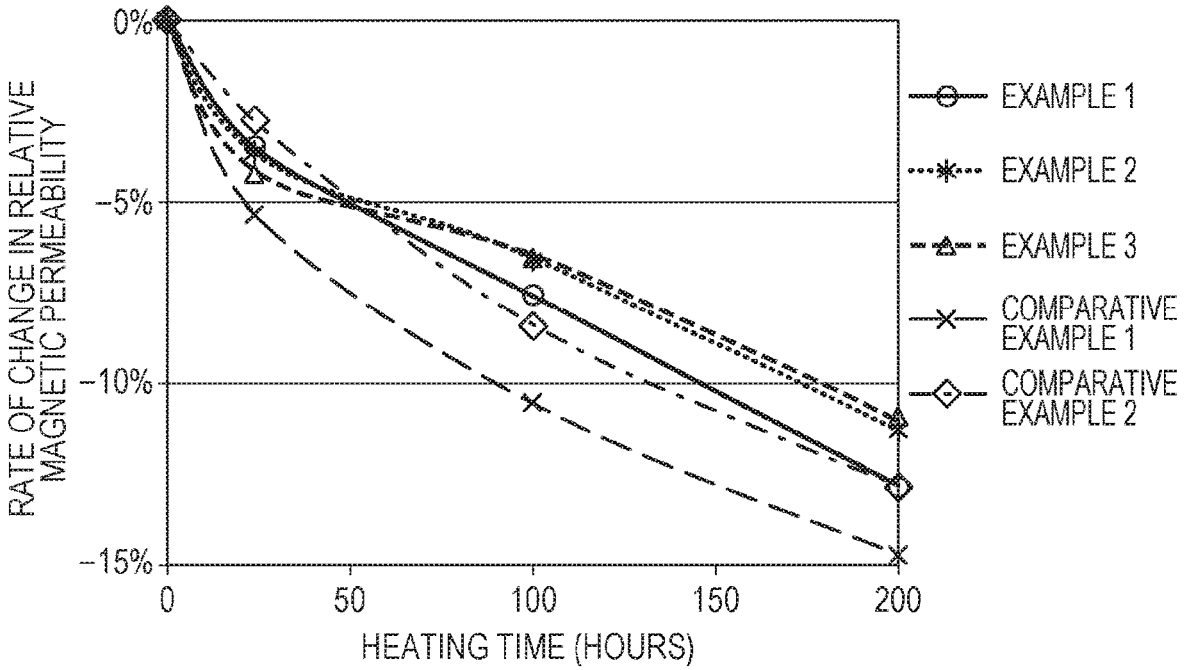
FIG. 4 is a graph showing the heating time dependence of the rate (%) of change in relative magnetic permeability in examples.

Results obtained by measuring the rate Rμ of change in relative magnetic permeability for different heating times are shown in Table 1 and FIG. 4.

TABLE 1

| | Heating time | | |
|---|---|---|---|
| | 24 hours | 100 hours | 200 hours |
| Example 1 | −3.5% | −7.6% | −12.8% |
| Example 2 | −3.6% | −6.6% | −11.2% |
| Example 3 | −4.2% | −6.5% | −11.0% |
| Comparative Example 1 | −5.4% | −10.5% | −14.7% |
| Comparative Example 2 | −2.8% | −8.4% | −12.8% |

Experiment Example 2

Measurement of Rate Change in Core Loss

A toroidal coil was obtained by winding a copper wire around the dust core prepared in each of the examples and the comparative examples. The toroidal coil was measured for core loss under conditions including a frequency of 100 kHz and a maximum magnetic flux density of 100 mT using a BH analyzer ("SY-8218" manufactured by Iwatsu Electric Co., Ltd.). The core loss is referred to as "initial core loss W0".

The toroidal coil was left in a 250° C. environment for a predetermined time. After being left therein, the toroidal coil was measured for core loss in the above manner. The core loss is referred to as "post-heating core loss W1".

The rate RW (%) of change in core loss was determined by the following equation:

$$RW=(W1-W0)/W0\times100 \quad 1.$$

Figure 5:
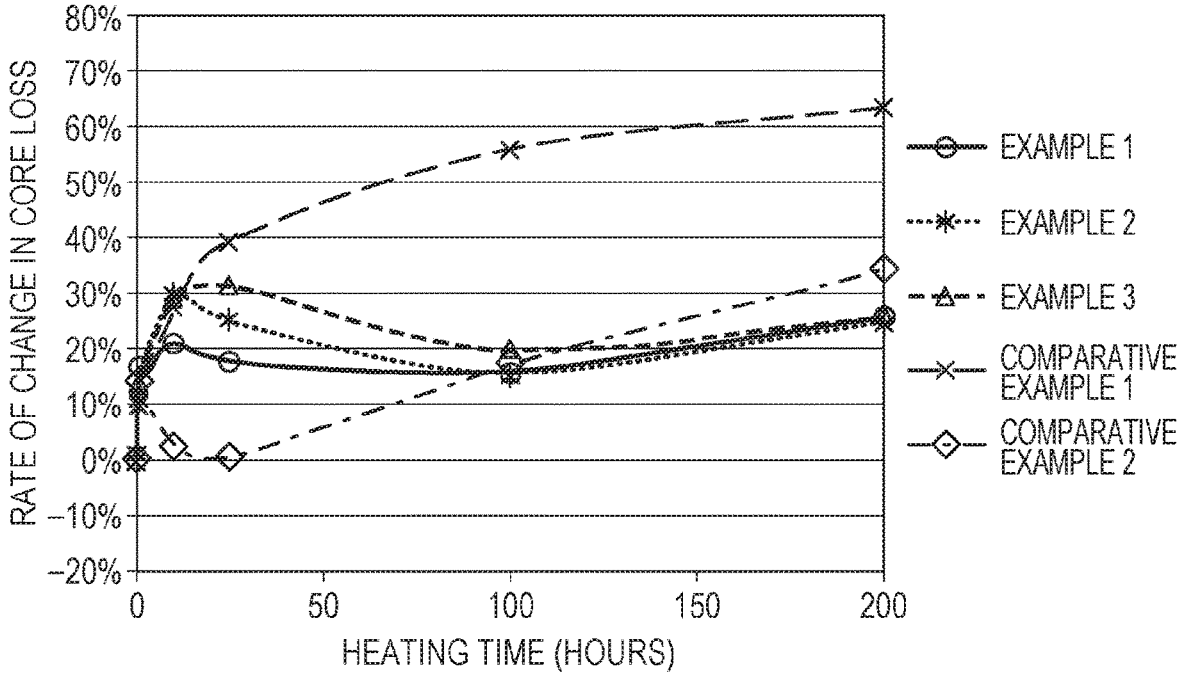
FIG. 5 is a graph showing the heating time dependence of the rate (%) of change in core loss in examples.

Results obtained by measuring the rate RW of change in core loss for different heating times are shown in Table 2 and FIG. 5.

TABLE 2

| | Heating time | | | | |
|---|---|---|---|---|---|
| | 1 hour | 10 hours | 24 hours | 100 hours | 200 hours |
| Example 1 | 16.5% | 20.5% | 17.4% | 15.8% | 26.2% |
| Example 2 | 13.8% | 29.3% | 24.7% | 15.5% | 25.2% |
| Example 3 | 10.3% | 28.7% | 31.3% | 19.7% | 26.1% |
| Comparative | 8.3% | 27.4% | 39.2% | 55.8% | 63.4% |

TABLE 2-continued

| | Heating time | | | | |
|---|---|---|---|---|---|
| | 1 hour | 10 hours | 24 hours | 100 hours | 200 hours |
| Example 1 | | | | | |
| Comparative Example 2 | 13.1% | 1.8% | 0.0% | 16.7% | 34.7% |

Experiment Example 3

Measurement of Radial Crushing Strength

The dust core prepared in each of the examples and the comparative examples was measured by a test method according to JIS Z 2507:2000, whereby the pre-heating radial crushing strength (MPa) was determined.

The dust core prepared in each of the examples and the comparative examples was left in a 250° C. environment for 200 hours. After being left therein, the dust core was measured by the test method according to JIS Z 2507:2000, whereby the post-heating radial crushing strength (MPa) was determined.

Figure 6:
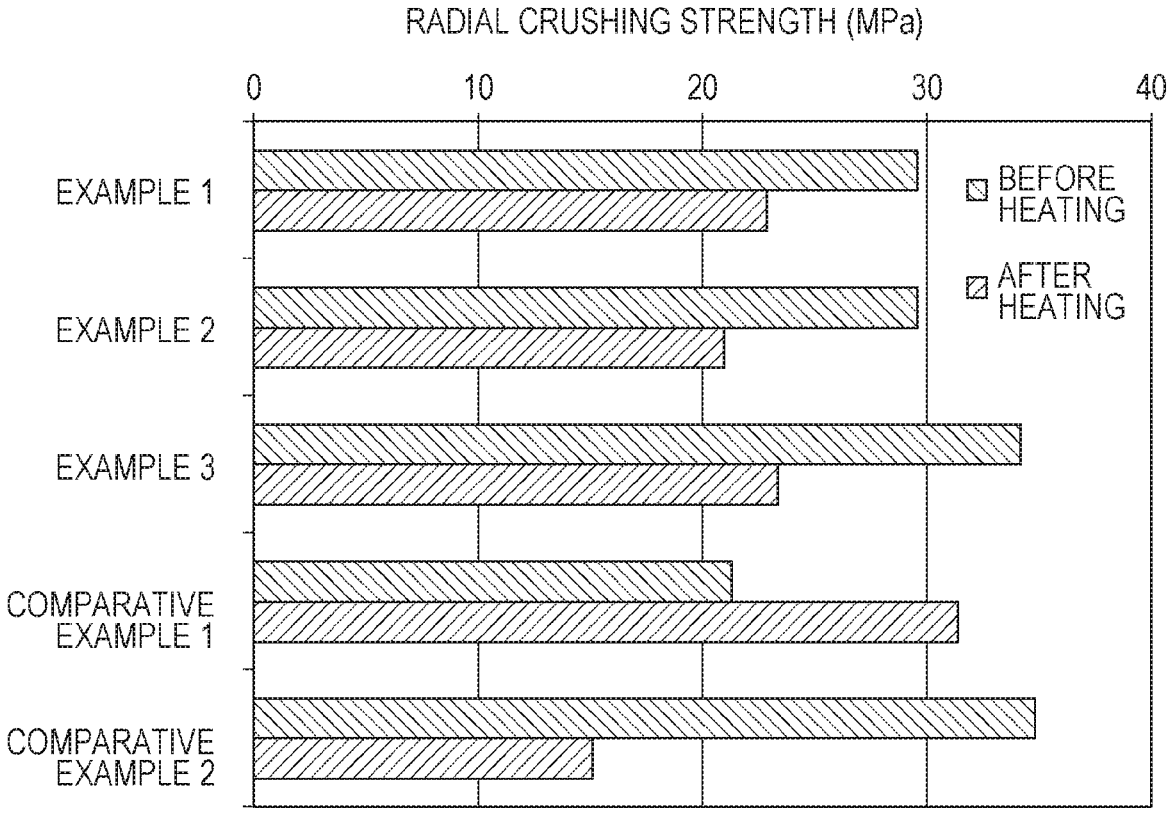
FIG. 6 is a graph showing measurement results of the radial crushing strength before and after heating in examples.

Measurement results of pre-heating radial crushing strength and post-heating radial crushing strength are shown in Table 3 and FIG. 6.

TABLE 3

| | Radial crushing strength (MPa) | |
|---|---|---|
| | Before heating | After heating |
| Example 1 | 29.6 | 22.8 |
| Example 2 | 29.6 | 20.9 |
| Example 3 | 34.2 | 23.3 |
| Comparative Example 1 | 21.2 | 31.3 |
| Comparative Example 2 | 34.7 | 15.0 |

As shown in Tables 1 to 3 and FIGS. 4 to 6, in the dust cores, according to the examples, left in the 250° C. environment for 200 hours, the rate of reduction in relative magnetic permeability is 13% or less, the rate of increase in core loss is 30% or less, and the radial crushing strength is 20 MPa or more. However, in the dust cores, according to the comparative examples, the rate of reduction in relative magnetic permeability is more than 13%, the rate of increase in core loss is more than 30%, and the radial crushing strength is less than 20 MPa; hence, both excellent magnetic properties and mechanical strength cannot be maintained.

An electronic component including a dust core according to the present invention can be preferably used in boosting circuits for hybrid automobiles, reactors used in generators or transforming stations, transformers, choke coils, and the like.

What is claimed is:

1. A dust core adapted to be used with a coil, the dust core comprising:

a compact containing a soft magnetic powder and a binding component, the compact having an outer surface having irregularities derived from the soft magnetic powder, and the compact having cavities therein; and a cover coat which is in direct contact with and covers the entire outer surface of the compact as a layer, the cover coat covering the irregularities of the outer surface and filling at least part of the cavities in the compact, the cover coat containing a polyamideimide-modified epoxy resin which is a product of reaction of a polyamideimide resin and an epoxy compound.

2. The dust core according to claim 1, wherein the soft magnetic powder contains a powder of at least one of iron-based materials and nickel-based materials.

3. The dust core according to claim 1, wherein the soft magnetic powder contains particles of a crystalline magnetic material.

4. The dust core according to claim 1, wherein the soft magnetic powder contains particles of an amorphous magnetic material.

5. The dust core according to claim 1, wherein the soft magnetic powder contains particles of a nano-crystalline magnetic material.

6. The dust core according to claim 1, wherein the soft magnetic powder is a mixture of two or more of a crystalline magnetic material, an amorphous magnetic material, and a nano-crystalline magnetic material.

7. The dust core according to claim 1, wherein the binding component is made of a pyrolysis residue of a binder containing a resin material.

8. A method for manufacturing the dust core according to claim 1, the method comprising:

providing a mixture containing the soft magnetic powder and a binder containing a resin material;

molding the mixture to obtain a molded product, the molding including compacting the mixture;

heating the molded product to obtain the compact which contains the soft magnetic powder and the binding component, an outer surface of the compact having irregularities derived from the soft magnetic powder, the binding component being made of a pyrolysis residue of the binder, thereby the compact having cavities therein; and forming the cover coat in direct contact with at least an outer surface of the compact and containing the polyamideimide-modified epoxy resin, the forming the cover coat including:

providing a liquid composition containing at least one of a polyamideimide resin and a precursor thereof, and an epoxy compound; and contacting the compact with the liquid composition, thereby forming the layer based on the liquid composition over the entire outer surface of the compact so as to allow a reaction of an epoxy group contained in the epoxy compound contained in the layer to proceed, whereby the cover coat covers the irregularities of the outer surface and filling at least part of the cavities of the compact.

9. The method according to claim 8, wherein the cover coat increases a mechanical strength of the compact and/or reduces changes in magnetic properties of the compact due to oxidation.

10. The method according to claim 8, wherein the contacting the compact with the liquid composition includes:

impregnating the liquid composition into an inner structure of the compact beyond the outer surface of the compact, thereby forming an impregnation structure in the compact.

11. An electric/electronic component comprising:

the dust core according to claim 1;

a coil; and a connection terminal connected to each end portion of the coil, wherein at least one portion of the dust core is placed so as to be located in an induced magnetic field generated by a current flowing in the coil through the connection terminal.

12. An electric/electronic device comprising the electric/electronic component according to claim 11.

13. The dust core according to claim 1, wherein the cover coat increases a mechanical strength of the compact.

14. The dust core according to claim 1, wherein the layer includes an extending portion impregnated into an inner structure of the compact beyond the surface of the compact.

15. The dust core according to claim 1, wherein the polyamideimide-modified resin is formed from a liquid composition containing at least one of the polyamideimide resin and a precursor thereof, and the epoxy compound, as a thermo-reaction product of the polyamideimide resin reacted with an epoxy group contained in the epoxy compound in the liquid composition.

16. The dust core according to claim 1, wherein the cavities in the compact are formed between adjacent particles of the soft magnetic powder.

17. The dust core according to claim 1, wherein the cover coat reduces changes in magnetic properties of the compact due to oxidation.

18. A dust core adapted to be used with a coil, the dust core comprising:

a compact containing a soft magnetic powder and a binding component, the compact including cavities formed between adjacent particles of the soft magnetic powder therein, the compact having an outer surface having irregularities derived from the soft magnetic powder; and a cover coat formed over the outer surface of the compact as a layer and in direct contact therewith such that the cover coat covers the irregularities, the cover coat including an impregnation structure in the compact which is an extending portion impregnating into an inner structure of the compact beyond the outer surface of the compact so as to fill at least part of the cavities of the compact, the cover coat containing a polyamideimide-modified epoxy resin which is a product of reaction of a polyamideimide resin and an epoxy compound.

19. The dust core according to claim 18, wherein the impregnation structure provides at least one of increasing a mechanical strength of the compact, increasing adhesion of the cover coat to the compact, and reducing changes in magnetic properties of the compact due to oxidation.

20. The dust core according to claim 18, wherein the cover coat coves the entire outer surface of the compact.

* * * * *